US005696337A

United States Patent [19]

Hall

[11] Patent Number: 5,696,337

[45] Date of Patent: Dec. 9, 1997

[54] CONCAVE FINGER BOARD FOR STRINGED INSTRUMENTS

[76] Inventor: Charles R. Hall, 2602 W. 68th Pl., Tulsa, Okla. 74132

[21] Appl. No.: 600,846

[22] Filed: Feb. 13, 1996

[51] Int. Cl.[6] ..... G10D 3/06

[52] U.S. Cl. ..... 84/314 R; 84/314 N; 84/298; 84/307

[58] Field of Search ..... 84/314 R, 314 N, 84/293, 307, 298, 299

[56] References Cited

U.S. PATENT DOCUMENTS

| | | | |
|---|---|---|---|
| 554,828 | 2/1896 | Maldura | 84/307 |
| 1,290,177 | 1/1919 | Grimson | 84/314 R |
| 3,018,680 | 1/1962 | Paul | 84/1.16 |
| 3,398,622 | 8/1968 | Smith | 84/267 |
| 3,398,623 | 8/1968 | Smith | 84/267 |
| 3,426,638 | 2/1969 | Smith | 84/291 |
| 3,691,285 | 9/1972 | Larrison | 84/1.16 |
| 3,785,239 | 1/1974 | Smith | 84/314 |
| 4,069,732 | 1/1978 | Moskowitz et al. | 84/1.16 |
| 4,248,127 | 2/1981 | Liber | 84/314 N |
| 4,311,078 | 1/1982 | Falgares | 84/314 |
| 4,534,260 | 8/1985 | Burrell | 84/293 |
| 4,633,754 | 1/1987 | Chapman | 84/314 N |

*Primary Examiner*—Michael L. Gellner
*Assistant Examiner*—Shih-yung Hsieh
*Attorney, Agent, or Firm*—Head, Johnson & Kachigian

[57] ABSTRACT

A musical instrument, such as a guitar, having strings across a bridge, a finger board and a nut wherein the bridge, finger board, and nut have a concave curvature. Preferably, the concave curvature is a hyperbolic curve. The resulting string arrangement is designed to minimize wrist and finger strain associated with playing the instrument.

7 Claims, 2 Drawing Sheets

CONCAVE FINGER BOARD FOR STRINGED INSTRUMENTS

BACKGROUND OF THE INVENTION

This invention relates to stringed musical instruments, particularly guitars. Such instruments, as is well known in the art, have been constructed such that the bridge, fingering board, and nut that supports the tensioned strings are in the same plane. Such configurations make it difficult for many persons because of wrist and finger strains, particularly to beginners.

The prior art is replete with a variety of methods to provide the chording finger positions to be comfortable. U.S. Pat. Nos. 3,785,239; 4,534,260; 3,398,622 and 3,426,638 are typical. Other U.S. Pat. Nos. such as 5,554,828; 4,311,078 and 3,691,285 have taught fingering and fret boards being convex.

SUMMARY OF THE INVENTION

Accordingly, it is a primary object of the invention to provide a musical instrument that uses tensioned strings wherein the bridge, the fingering or fret board, and nut have a concave-like curvature; and thus, provide a comfortable configuration providing the strings within easy reach of the player's chording hand and fingers.

DETAILED DESCRIPTION OF THE PREFERRED EMBODIMENT

While the invention will be described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
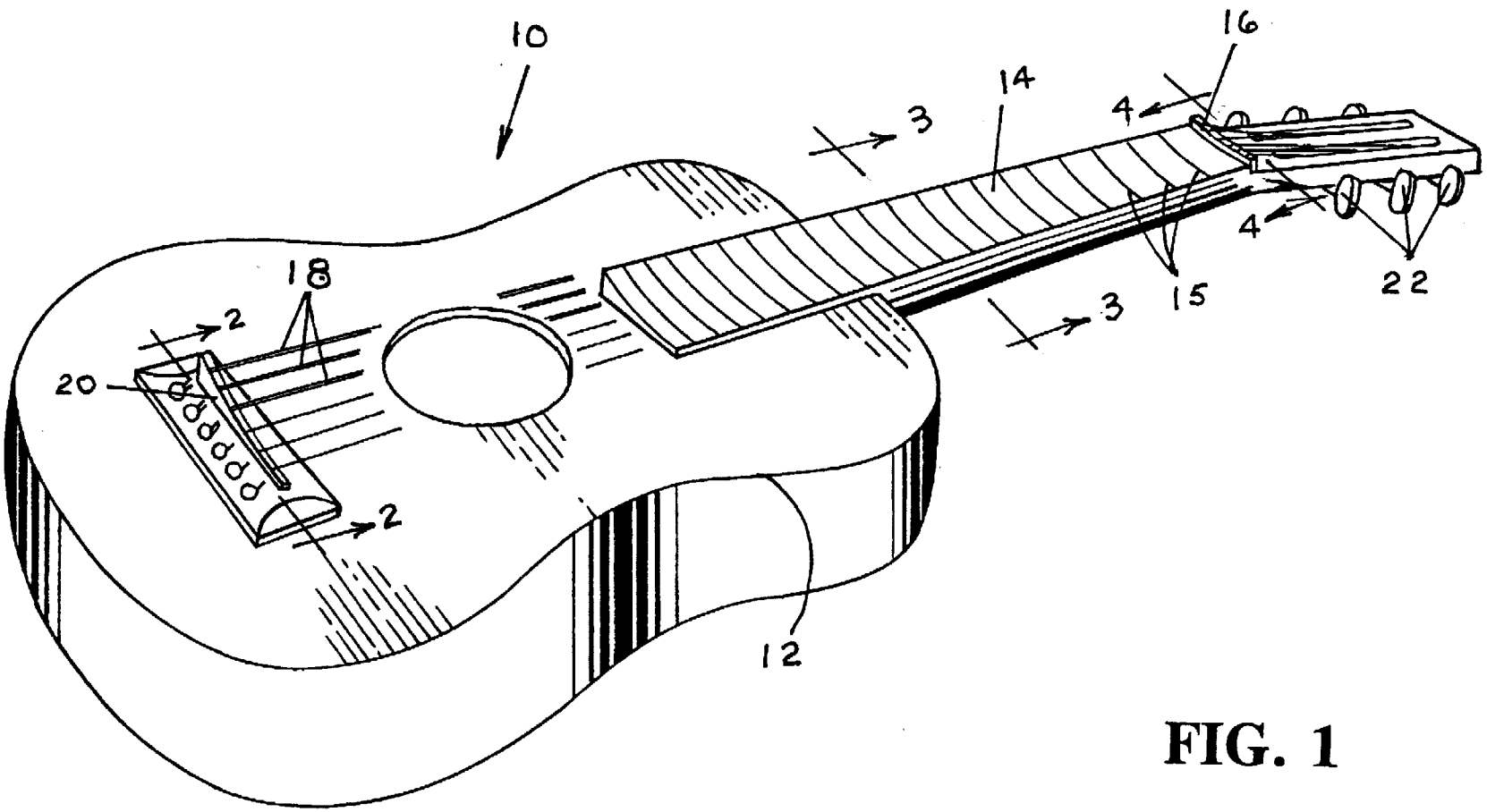
FIG. 1 is a perspective view of a guitar constructed according to this invention.
Figure 2:
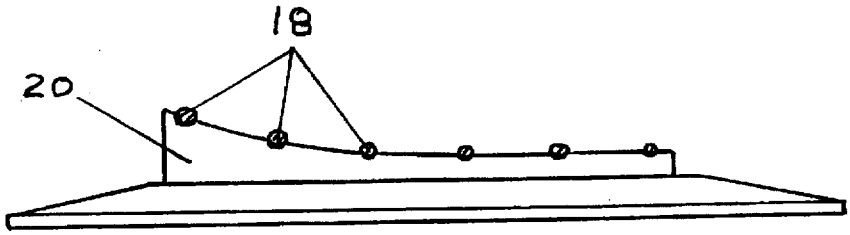
FIG. 2 is an elevational view of the bridge of the guitar shown in FIG. 1 and taken along the line 2—2.

Referring to the drawings, the guitar shown herein is generally designated by the numeral 10 as an acoustic hollow body 12 of conventional shape and constructed to be joined to the neck 14. The neck is provided with a nut that's over the nut 16 to the stringed tightening devices 22. The curvature of the bridge 20, fingering board 14 and nut 16 are best described in FIGS. 2, 3 and 4.

Figure 3:
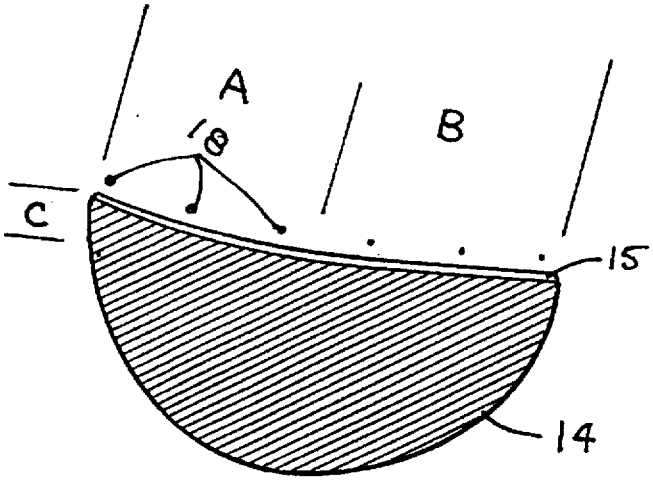
FIG. 3 is a sectional view taken along the line 3—3 of FIG. 1.
Figure 4:
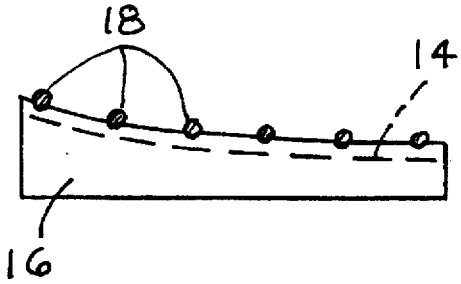
FIG. 4 is an elevational view of the nut taken along the line 4—4 of FIG. 1.

Referring particularly to FIG. 3, the preferred embodiment, although of an essentially concave curvature showing the fingering board of an essentially concave configuration, the actual curve is more of a hyperbolic curve divided into two sections, A being of a greater curvature joining with a flatter portion B. The depth C is approximately ¼ inch.

Although the invention has been described specifically with regard to a guitar, it is to be understood that the invention is adaptable to other tensioned stringed instruments, such as banjos and mandolins and those with or without frets and thus, provide an efficient stringed musical instrument wherein the musician or beginning artist will be able to play and chord the string with minimal wrist and finger strain.

What is claimed is:

1. A musical instrument having tensioned strings that extend longitudinally across a bridge having a surface, a finger board, which defines a playing surface, and a nut having a surface, said nut and said bridge each having recesses to receive said strings and support said strings in spaced disposition to said playing surface, each of said bridge, said finger board, and said nut surfaces having a concave curvature in a direction orthogonal to said strings, said curvatures being continuous across each said surface, and whereby an imaginary line across said strings substantially follows said curvature.

2. The instrument of claim 1 wherein said curvature is a hyperbolic curve.

3. The instrument of claim 2 wherein said instrument is a guitar.

4. The instrument of claim 1 wherein said curvature is divided into a curved upper section A from said top edge to flatten lower portion B, said top edge of section A being above an imaginary plane through said lower portion B.

5. The instrument of claim 1 wherein said instrument is a guitar.

6. The instrument of claim 1 wherein said playing surface including frets, that substantially follow said curvature.

7. The instrument of claim 1 wherein said instrument is a banjo.

* * * * *